US005952056A

United States Patent [19]

Jordan et al.

[11] Patent Number: 5,952,056

[45] Date of Patent: Sep. 14, 1999

[54] METAL FORMING PROCESS

[75] Inventors: Richard Michael Jordan, Hook Norton; Allen Dennis Roche, Cwmdare, Aberdare, both of United Kingdom

[73] Assignee: Sprayform Holdings Limited, Swansea, United Kingdom

[21] Appl. No.: 08/823,181

[22] Filed: Mar. 24, 1997

[51] Int. Cl.[6] ..... C23C 4/08

[52] U.S. Cl. ..... 427/455; 427/419.2; 427/404; 427/422; 427/424; 427/425; 427/427; 427/426

[58] Field of Search ..... 427/427, 422, 427/426, 424, 425, 404, 410.2, 455

[56] References Cited

U.S. PATENT DOCUMENTS

| | | | |
|---|---|---|---|
| 3,976,809 | 8/1976 | Dowell | 427/34 |
| 4,297,135 | 10/1981 | Giessen et al. | 75/123 B |
| 4,655,852 | 4/1987 | Rollis | 148/6.11 |
| 4,666,733 | 5/1987 | Wlodek | 427/376.6 |
| 5,338,577 | 8/1994 | Burdette | 427/453 |
| 5,607,779 | 3/1997 | Naoi | 428/634 |
| 5,656,787 | 8/1997 | Shivanath et al. | 75/228 |
| 5,658,506 | 8/1997 | White et al. | 264/28 |

FOREIGN PATENT DOCUMENTS

| | | | |
|---|---|---|---|
| 0 075844 | 4/1983 | European Pat. Off. | C23D 5/10 |
| 0 285 313 | 3/1988 | European Pat. Off. | C23C 4/02 |
| 2 518 123 | 6/1983 | France | C23D 5/10 |
| 2 069 537 | 1/1981 | United Kingdom | C23C 7/00 |
| 2 077 301 | 12/1981 | United Kingdom | C23C 7/00 |
| 2069537 | 8/1991 | United Kingdom | C23C 7/00 |
| WO 93/05194 | 3/1993 | WIPO | C23C 4/02 |
| WO 96/09421 | 3/1996 | WIPO | C23C 4/02 |

OTHER PUBLICATIONS

"Thermal Stability of NiCrAlY/PSZ FGM by Plasma Twin Torches Method" by Shinohara et al., ISIJ International, vol. 32 No. 8 (1992).

*Primary Examiner*—Benjamin Utech
*Assistant Examiner*—Donald L. Champagne
*Attorney, Agent, or Firm*—David P. Gordon; David S. Jacobson; Thomas A. Gallagher

[57] ABSTRACT

Atomized metal is deposited metal onto a substrate so as to cause at least partial solidification of the deposited metal; further atomized metal is deposited onto the partially solidified deposited metal on the substrate; and the metal deposited onto the partially solidified deposited metal is allowed to fully solidify on the substrate; the cooling of the further deposited metal, and the composition of the metal and/or of a gas used in the atomization of the further atomized metal being tailored such that volumetric contraction on solidification and cooling of the further deposited metal is compensated for, when the deposited metal has been cooled to ambient temperature, by volumetric expansion in a reaction or phase change in the further deposited metal.

21 Claims, 5 Drawing Sheets

METAL FORMING PROCESS

BACKGROUND OF THE INVENTION

The present invention is concerned with a metal forming process and, in particular, a metal forming process involving spray deposition of atomized metal onto a substrate. (The term metal, as used herein, encompasses pure metal, metal alloys and composites having metal matrices, and ceramics).

Spray deposited products are made by an incremental process in which the product is built up from successive layers of deposit. In most cases this means that the last deposited layer is laid down on a cooler earlier deposit. This generally leads to the build up of internal stresses because of volumetric changes occurring during cooling; these internal stresses may lead to distortion or cracking of the product.

In order to eliminate distortion and cracking it is necessary to develop a suitable spray strategy and a means of controlling the volumetric changes that occur during cooling of the successive deposited layers.

Volumetric changes occur in three regions of a solidifying metal. Firstly, in the region above the liquidus, volumetric changes occur as cooling takes place, but no stresses develop because of the flow of liquid. Secondly, in the region between the liquidus and solidus, volume changes do occur but internal stresses do not develop on cooling until only a small fraction of liquid remains, in which case super-solidus cracking may occur.

The third region in which internal stresses (compressive or tensile) may develop on cooling is below the solidus temperature; these stresses may result in distortion or cracking. Here two phenomena are important:

(a) further shrinkage in most metals directly related to their coefficients of thermal expansion, and (b) phase changes occurring as the temperature falls, or the inclusion of reaction products formed by reaction with the atomizing gas, for example, leading to volumetric changes which are superimposed on (a).

Both of these phenomena can affect the build up of internal stresses, and therefore distortion of the product with, in extreme cases, cracking or spalling.

We have now developed a spray deposition metal forming process in which this build-up of internal stresses resulting from thermal contraction or shrinkage on solidification or cooling can be matched or offset by other volumetric changes taking place in the deposit.

SUMMARY OF THE INVENTION

The process according to the invention comprises the steps of:

(i) depositing atomized metal onto a substrate so as to cause at least partial solidification of the deposited metal;

(ii) depositing further atomized metal onto said partially solidified deposited metal on said substrate; and (iii) allowing the metal deposited onto said partially solidified deposited metal to fully solidify on the substrate;

the cooling of the further atomized and/or further deposited metal, and the composition of the metal and/or of a gas used in the atomization of the further atomized metal being tailored such that volumetric contraction on solidification and cooling of said further deposited metal is compensated for, when said further deposited metal has cooled to ambient temperature, by volumetric expansion associated with a reaction or phase change in said further deposited metal.

The metal may be sprayed on to a substrate (such as a pattern) using an atomized spray of metal in which either air, or an inert gas, or a reactive gas is used for atomizing; such that the product is built up incrementally in spray deposited layers, the metal and the atomizing gas being chosen such that phase changes occur and/or reaction products with the atomizing gases are formed and/or particles are introduced during at least part of the deposition process, leading to an expansion or relatively lower contraction in volume of the last layers of deposit, to offset the normal thermal contraction occurring during cooling, to the extent that the last layers have greatly reduced internal stresses, or the whole product has a stress system where component stresses counteract each other in a way such that the product is substantially free from distortion, cracking, or spalling.

It has been found that under the conditions of spray forming where the product is built up from successive layers of spray deposit, certain metal compositions are particularly useful because phase changes can be made to occur and/or reaction products incorporated which can cause expansion after deposition and therefore give the unusual and unexpected benefit of offsetting the volumetric changes outlined in (a) by the changes outlined in (b). By controlling the conditions of spray deposition, and therefore the thermal history of the spray, and therefore the temperature of deposition, and by selecting a suitable metal composition, and/or by choosing a reactive or non-reactive gas as appropriate to the metal composition, it is possible to produce a product in which internal stresses are minimised, and so distributed and balanced, that the product does not distort during manufacture or in subsequent use.

Benefits can also be obtained by grading compositions such that the later deposits consist of compositions that show lower or even negative shrinkage (i.e. expand as temperature is lowered over a particular temperature range) compared with the earlier deposits. Such deposits can be made in a controlled graded manner or in some circumstances can be made in a manner in which the composition shows a step change.

We have also found that, when depositing steel on a substrate, the use of certain steels (such as carbon steels) under appropriate conditions can result in compressive stresses in the deposit; with appropriate control, therefore, a deposit can be formed according to the invention with net stresses approximating to zero.

Steels undergo various phase changes as they cool and these have been found to be particularly useful in helping to control stresses during spray deposition. The transformations from austenite to ferrite, pearlite, bainite, or martensite during cooling of certain steel all involve positive volumetric changes. This has been well documented in the technical and scientific literature.

This effect has also been described previously by Stanton, who reported on the contraction stresses that occur in sprayed metal deposits (Metal Industry, Dec. 19, 1958 pp 509–511). But Stanton only reported smaller tensile stress formation in this work. He did not report any ability to produce neutral or compressive stresses, despite the obvious benefits in so doing if this could have been achieved in his work. Indeed, it is well known that many researchers have been striving to control stresses and produce neutral stresses in thick sprayed steel and other deposits over several decades, since the benefits in so doing, for the production of net-shape products by spray deposition, are very great.

But the precise way in which the various transformations take place in products produced by spray depositing are peculiar to the spray depositing process itself. This is due to the rapid nature of the solidification processes that occur during spray depositing, which frequently leads to undercooling in the molten metal droplets in flight, leading to a delay in the onset of solidification. Rapid cooling and undercooling would also affect the way that nucleation of solid then occurs within the droplets in flight. None of these can be precisely predicted and therefore the precise nature of the phase transformations and the volume % of the phases and the effect on stresses cannot be predicted either. So it is not surprising that no previous workers have discovered how to reliably control stresses during spray deposition, by controlling the phase changes that can occur in steels, or that can occur in other materials too.

Indeed there are many aspects of the present invention that are surprising and unexpected in addition to this.

For example, the phase transformation from austenite to martensite, and formation of 100% martensite, would lead to an instantaneous volumetric change of approximately 4.3% as calculated from first principles from the lattice dimensions of the unit cells of these two phases. These calculations occur in many standard metallurgical undergraduate texts, for example in (ref: R. E. Reed Hill; Physical Metallurgy Principles; Van Nostrand; 1st ed. 1964; p 503).

Now consider the Fe—C phase diagram (attached hereto as FIG. 5), and the various phase transformations that can occur (ref: Hansen; Constitution of Binary Alloys; McGraw Hill; 2nd ed. 1958). These phase transformations must also be considered in relation to the well known Time-Temperature-Transformation curves established for many steels, an example of which is attached hereto as FIG. 6 (ref: US Steel Company; Atlas of Isothermal Diagrams, also reproduced in Reed-Hill). The phases that form depend on the rate at which the steel is cooled. This is described in most standard texts on the subject, for example in Reed-Hill. When cooling is rapid, as would be expected for metal droplets in flight during spray deposition, then the $\gamma \rightarrow \alpha + Fe_3C$ phase transformation is suppressed and martensite is formed at the martensite start temperature ($M_s$) in FIG. 6. A eutectoid steel containing ~0.8% carbon cooling 1190° C. from the solidus temperature at 1400° C. to the martensitic transformation temperature of 210° C. (ref: Honeycombe, Steels, Microstructure and Properties, Edward Arnold, 1st ed, 1981) would be expected to undergo a linear contraction of $1190 \times 12 \times 10^{-6} = 0.01428$ inches per inch. This is calculated using a coefficient of thermal contraction for austenite of $12 \times 10^{-6}$ per °C. This may be an underestimate of this coefficient; the actual contraction may be more than this (See data in C. J. Smithells; Metals Reference Book; Butterworths; 5th ed 1976). The volumetric contraction can then be calculated conservatively as:

$$(1.0)^3-(1.0-0.0148)^3=0.0437 \text{ or approximately } 4.37\%.$$

This is greater than the 4.3% maximum volumetric increase that could be expected from the martensitic transformation described in Reed-Hill above, even if 100% martensite were formed; and therefore based on this calculation it would not be assumed possible to achieve sufficient compressive component from the phase transformation to counteract the tensile stresses due to cooling. Similar calculations based on the other possible transformations to ferrite, bainite or pearlite would lead to similar conclusions.

Yet another surprising finding according to the present invention is the fact that it has been found possible to produce martensite and to develop neutral or compressive stresses in steels deposited under conditions where the steady state deposition temperature appears to be above the martensitic transformation temperature. While a volumetric increase would be expected due to the other transformations of austenite to ferrite, bainite or pearlite, these transformations all require time for diffusion to occur, and would not be expected to produce the same instantaneous stress relief, to the same good effect, as would an instantaneous martensitic shear process. It is unlikely that the other reactions would produce an effect fast enough to prevent spalling of spray deposited material during the spray depositing process, for example.

Both the ability to generate neutral or compressive stresses, and also the fact that martensite has been observed in steels where the steady state deposition temperature is above the martensitic transformation temperature are now attributed, according to the present invention and with the knowledge of hindsight, to the non-equilibrium nature of the sprayforming process. In retrospect, it is believed that the effects observed during the process, and therefore the mechanisms for achieving stress relief according to the present invention, are as follows:

(a) On sprayforming, metal droplets are undercooled before the first solid is formed. That is to say that in the above example describing the previously expected behaviour of a 0.8% C steel, the nucleation of solid would not occur at the equilibrium solidus temperature. In fact this nucleation would be delayed—maybe considerably delayed—until some lower temperature. The contraction stresses developed in the austenite would then be reduced, because they would result only from cooling from the final nucleation temperature down to the martensitic transformation temperature. If, for example, nucleation first occurred at 805° C. instead of 1400° C., then the linear contraction would be precisely half that calculated previously in the example, leading to a volumetric contraction calculated as before of ~2.2%; and the formation of approximately 51% martensite at the martensitic transformation temperature would be sufficient to compensate for the thermal contraction stresses in the austenite.

(b) With regard to the observation that martensite appears to form, in practice, in samples of. 0.8% C steel deposited under conditions where the steady state deposition temperature is above the martensitic transformation temperature, this can also be explained by the non-equilibrium nature of the process. In hindsight it is entirely possible that individual droplets would cool below the martensitic transformation temperature before recalescing to a higher temperature on the substrate due to the evolution of latent heat. The conditions that would lead to this are not readily predictable "a priori", but the practical observations made in executing various embodiments of the current invention would point strongly towards the operation of this mechanism.

In any case, we have in fact been able to achieve precisely the desired effects and stress control, not only in 0.8%C steels, but also in other materials too, as will be described later.

The martensitic transformations in various steels (e.g. in the Fe—C and Fe—Ni systems) are particularly useful again, because in many cases the spray deposition temperatures can be controlled around the martensitic transition temperatures. Martensitic transformation temperatures are typically in the region of 200° C. in the Fe—C system, as mentioned previously, and this has proved particularly useful in the present invention because small changes in deposition temperature have been used to "fine-tune" the process.

It will also be realised that the process of stress control can also be fine-tuned by the additional application of simultaneous spray peening (for example, as described in GB patent 1605035) in combination with the phase change mechanisms described above.

According to a further aspect of the invention, therefore, there is provided a method of forming a sprayed deposit of steel on a substrate, which comprises providing at least one atomized stream of molten martensitic (that is, martensite-forming) steel, and directing the or each said atomized stream towards the substrate to form sequentially deposited layers of steel, under an atmosphere preferably containing no more than 12% by weight of oxygen, the balance predominantly comprising a non-reducing, non-oxidising gas (such as nitrogen, which is preferred, argon or helium), and cooling of the deposited steel in such a way that martensitic transformation takes place. The martensitic steel is preferably a carbon steel.

It will also be realised that similar phase changes can occur in materials other than carbon steels. For example martensitic reactions occur in a variety of materials, such as Fe—Ni; Fe—Ni—C; pure Ti; Ti—Mo; Au—Cd; In—Tl, as described in Reed-Hill.

Atomization conditions may be chosen, as is known in the art, to control the size, velocity, direction and temperature of the sprays of hot metal particles. On being atomized, the particles of molten metal spread out in a conical spray pattern, which may be of circular cross-section or may be modified, as also known in the art, to form a different cross-section or a more even spread of steel particles.

The substrate may be any suitable surface, which may for example be flat or tubular, with the metal spray to be deposited on the inner or outer surface.

It is generally preferred that the atomized droplets be still at least partially liquid on impact, otherwise the deposit may be too porous. However, at least some of the droplets should be undercooled (that is, below the solidus temperature). By suitable control of the atomizing conditions, the sprayed metal is partially or fully liquid on impact, so that, where undercooled liquid particles are concerned, solidification takes place immediately on impact and there is no need for large amounts of heat to be extracted through the substrate.

It is possible to provide fibres, whiskers or particles of refractory material, e.g. carbon or silicon carbide, on the substrate in such a way that they become embedded in the coherent composite metal deposit and provide reinforcement for it. Also if desired, particles of refractory material can be incorporated in the spray. The substrate may be translated, or reciprocated, or rotated in order to collect the metal spray in the desired way. These features can be used to exercise further control over the structure of the deposit.

In some embodiments, a first stream of metal droplets may be supplied initially, followed by a second stream of metal droplets, so that the deposit consists of the first metal laminated with the second. The supply of molten metal in two or more streams gives the operator a great deal more latitude in determining the structure of a deposit.

For example, at least two layers of each metal may be formed in alternating superimposed relationship. The thickness of the alternating layers has a significant effect on the properties of the laminate. In the as-sprayed deposit, each layer preferably has a thickness in the range 0.01–10 mm, more preferably 0.05–0.5 mm.

In a further embodiment, metals having different volumetric changes on cooling may be sprayed simultaneously, for example, from the same spray nozzle or gun. It is believed that spraying of two or more such metals from the same spray nozzle or gun in a sprayforming or spray deposition process may be novel and inventive per se.

DETAILED DESCRIPTION OF THE PREFERRED EMBODIMENTS

Figure 1:
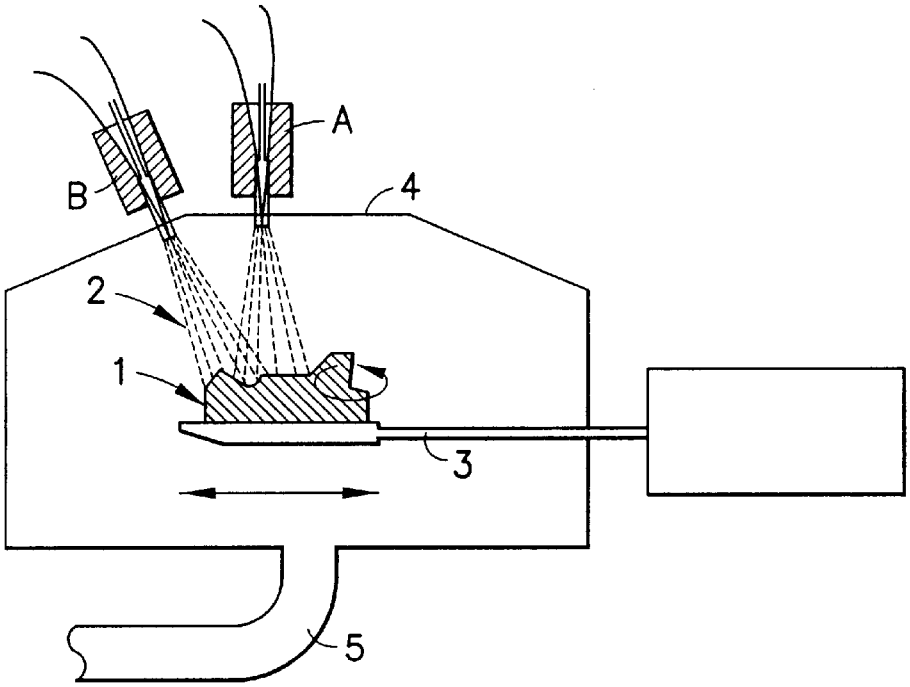
FIG. 1 shows an exemplary spray deposition metal forming process according to the invention.

The general apparatus arrangement for spray forming processes is shown in FIG. 1 and comprises one or more arc spray guns A,B producing atomized metal sprays 2 which are deposited on a substrate 1. The substrate is usually provided on a manipulator arm 3 which is movable translationally in mutually perpendicular directions, and is also rotatable. The substrate is typically positioned inside a spray chamber 4 which has an exhaust 5 to a wet scrubber.

Figure 2:
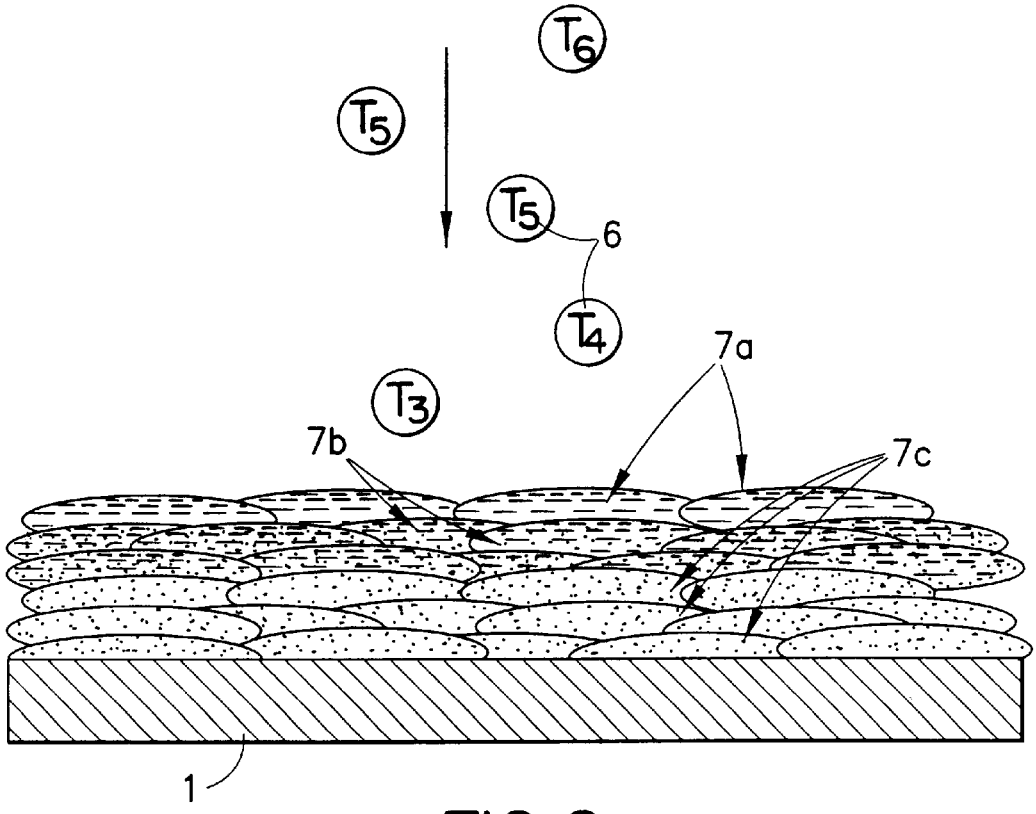
FIG. 2 is a schematic diagram illustrating how droplets build up incrementally in layers on the substrate.

Referring to FIG. 2, the metal spray comprises a multiplicity of atomized metal droplets 6. The deposit is built upon substrate 1 as partially liquid splats 7*a* land and solidify upon solid splats 7*b* which may be above the equilibrium steady state deposition temperature. Solid splats in the body of the deposit 7*c* attain and retain the equilibrium solid state deposition temperature.

Sprayforming processes are useful for producing tools, molds and dies for use in the plastics components and moldings industry because features of fine detail can be achieved. The substrate 1 typically comprises a master pattern of the article to be formed in plastics. The metal spray or sprays 2 are deposited on the surface of the master pattern substrate 1 to produce a working face of the tool mold or die formed in register with the surface of the master pattern substrate. Spraying is continued to build up a relatively thick body to the mould, tool or die; when the required thickness of solidified deposit is achieved, the spray deposited mold, tool or die body is released from the substrate master pattern 1.

Difficulties have previously been encountered in manufacturing sprayformed tools and dies in this way because high internal stresses during deposition and subsequent cooling at times causes marked distortion of the tools, dies or molds so formed. Means for controlling the internal stresses have been devised enabling sprayforming techniques to be utilised in manufacturing operations for forming tools and dies. The present invention is therefore particularly applicable to the production of tools and dies for use in the plastics molding industry.

Following manufacture of molds, tools or dies in accordance with the invention, they may subsequently be used in high volume, high pressure manufacturing processes for casting or molding articles of suitable materials (such as typically plastics).

The following worked examples are, in combination with the drawings, given by way of explanation and illustration in order that the way in which the invention may be put into operation may be more fully understood.

EXAMPLE 1 (COMPARATIVE)

A tubular substrate 75 mm external diameter was coated with 0.8% carbon steel to a thickness of 3 mm using nitrogen as the atomizing gas. On completion the deposit was cut to relieve overall stress and was found to have a smaller radius of curvature indicating a (surprising) compressive stress in the coating.

EXAMPLE 2 (COMPARATIVE)

Example 1 was repeated using air as the atomizing gas, the stress in the coating was found to be tensile with an increased radius of curvature.

It will be seen that the factors acting in favour of compressive stress in Example 1 can be counteracted by factors acting in favour of tensile stress in Example 2 so that by choosing appropriate metal/gas composition and rate of cooling, it is possible to achieve a beneficial phase change during cooling below the solidus temperature to produce a coating either with compressive stresses, or substantially stress-free, or with another particularly desired stress system that may be appropriate to particular product forms.

That is, the increase in the amount of phase change which occurs in the process involving spraying with nitrogen, compared to spraying with air, produces an increase in volume of the deposit resulting from solid state phase transformation, which could compensate for the tensile stresses arising from shrinkage, so that the internal stresses in the deposit would become compressive.

EXAMPLE 3

A flat substrate 75 mm×110 mm×10 mm thick was sprayed with low carbon steel containing less than 0.4% carbon, using air as the atomizing medium. The stress levels in the deposit were approximately neutral. However when (for comparison) the same substrate was sprayed with the same steel using nitrogen, tensile stresses were observed in the deposit on release from the substrate.

In this example, the level of carbon in the feedstock, and the cooling rates achieved were not sufficient to produce significant levels of martensitic phase transformation on cooling, but the presence of oxides resulting from the reaction of molten steel droplets with the air atomizing gas resulted in an increase in volume of the deposit as the density of the oxides is less than the matrix material which had the effect of counteracting the shrinkage stresses.

A similar effect can be produced by adding a second phase material to the matrix during deposition. In this case the volume increase is achieved by the second phase particles having a coefficient of expansion much less than the matrix material. A practical application of the above observations was found to be the making of spray formed shapes where the control of dimensions was particularly important.

EXAMPLE 4

When 18/8 stainless steel was sprayed in the same manner as described above the stress levels, when using metal spray deposited with air or nitrogen are both tensile, in character.

In this case the stainless steel did not produce significant levels of reactive products (i.e. oxides) and it is known that 18/8 stainless steel does not undergo any significant phase changes on cooling from the melting point. Therefore in this case, it is difficult to counteract the shrinkage stresses inherent when the metal is spray formed onto a relatively cold substrate.

To combat this tensile stress the procedure used was to deposit alternate layers of 18/8 and 0.8% carbon steel both atomized with $N_2$. This procedure allows the tensile stresses of the 18/8 deposit to be offset by the compressive stresses of the 0.8% carbon steel. This procedure is particularly useful when building up thick shells in the case of tools and dies made by spray forming using a replication technique.

EXAMPLE 5

The equipment consists of two arc spray guns set up as shown in FIG. 1. Gun A is positioned to spray metal at approximately right angles to the substrate surface. Gun B is positioned to spray at approximately 5 degrees to the substrate surface. The relative position of the guns is such that the spray material from each of the two guns strikes the substrate at the same position on the substrate, situated approximately 160 mm from the guns. The substrate is manipulated in a manner which attempts to deposit sprayed material to an even thickness over the substrate surface.

In this example arc spray gun A was operated at 80 amps using air as the atomizing medium and 0.8% carbon steel wires. (The operating amps is directly related to the feed rate of wire through the gun.) Gun B was operated at 97 amps with nitrogen gas as the atomizing medium and 0.8% carbon steel wire.

With these spraying conditions the equilibrium deposit temperature reached a steady state value of 257° C. The change in shape of the deposit, on removal of the substrate, indicated that compressive residual stresses had existed in the deposit prior to its removal from the substrate.

The deposit was also found to be very hard to cut, indicating that a substantial proportion of martensite and/or bainite and/or pearlite were present in the final product. In this case the volumetric changes associated with the phase changes occurring during spray deposition were more than sufficient to compensate for the thermal contraction stresses in the product, and net compressive stresses were introduced.

EXAMPLE 6

In this example the equipment was set up as described in Example 1. Gun A was operated at 140 amps with air as the atomizing medium and 0.8% carbon steel wires. Gun B was operated at 95 amps with nitrogen gas as the atomizing medium and 0.8% carbon steel wires.

In this case metal sprayed by Gun A, using air, reacted to some extent with the oxygen in the air. Carbon was oxidised and the level of carbon therefore reduced in the droplets. Iron oxides formed too, as evidenced by the metallurgical structure of the deposit, and the heat of reaction from both of these reactions increased the temperature of material sprayed from Gun A, which therefore arrived relatively hot, and probably well above the martensite start temperature $M_s$. The iron oxides formed resulted in an increase in volume, but the phase transformations in the steel deposited from Gun A would not have been expected to compensate for the thermal contraction stresses. Droplets arriving from Gun B, however, arrived on the substrate relatively cooler, and probably below the martensitic start temperature $M_s$, although it was not possible to measure this.

The combined effect of all these factors would have been impossible to predict without the experience gained during the course of the present invention, but the steady state temperature of the deposit on the substrate was measured as 364° C. The change in shape of the deposit on removal from the substrate indicated that tensile residual stresses had existed in the deposit prior to removal. In this case lower volumetric changes occurred than in Example 1, and these changes were insufficient to compensate for the tensile thermal contraction stresses, so that the net residual stress system in the deposit was tensile.

EXAMPLE 7

In this example only one of the arc spray guns was used i.e. Gun B, spraying at 45 degrees to the substrate surface.

This gun was operated at 95 amps with 0.8% carbon steel wires. The atomizing gas supplied to the gun was alternated between nitrogen and air. Each of the gases was used for periods of 30 seconds before switching to the alternative gas.

In this case the effects described in Example 1 were combined with the effects described in Example 2, and a layered structure was produced. The layering also produced the bi-metallic strip effect at the same time.

Again, the combined effects would have been impossible to predict. In this case, the steady state temperature of the deposit was 155° C., which is well below the martensitic start temperature $M_s$. The deposit on removal from the substrate exhibited no change in shape as compared to the substrate, indicating that a neutral stress situation existed within the deposit prior to removal from the substrate.

Although the combination of all of the effects described above lead to considerable difficulty in predicting the stress systems to be expected under a particular set of conditions, because of the precise control that can be exercised during the arc spray process and other sprayforming processes, the conditions can be replicated exactly, and the process is therefore very reproducible and controllable.

This particular process was repeated experimentally eight times in succession on one occasion, with precisely the identical result each time. Indeed the previous, and also the following examples, have also been found to be precisely reproducible under identical conditions too.

EXAMPLE 8

In this example the Gun B was used to generate the deposit.

The gun was operated at 100 amps using nitrogen gas as the atomizing media. The wire feed to the gun consisted of one spool of 0.8% carbon steel and one spool of copper. The two wires were fed into the gun at the same rate.

In this case, based on the embodiment of the invention described in Example 1, it would be anticipated that the steel component would be deposited on the substrate in compression due to the phase changes. The copper, on the other hand would be deposited in tension because there are no phase changes in copper to give the desired volumetric increase. The combined deposit of copper and steel was designed, based on previous embodiments of the invention, to give a net neutral stress system in the deposit.

The steady state temperature of the deposit was measured as 201° C., just below the martensitic start temperature $M_s$. The deposit on removal from the substrate exhibited no change in shape indicating that the stress pattern in this deposit was balanced and neutral.

EXAMPLE 9

The embodiment of the invention described in Example 4 produced a slightly more porous product than usual or desirable for many applications. This is due to the reduced deposition temperature required to generate a neutral stress system in this case, and in many specific cases it may be necessary to produce sprayed deposits at a low temperature and therefore with a higher than desirable level of porosity, where the primary requirement is to achieve a neutral stress situation. This would be the case for many coated products, and also particularly in the manufacture of tools and dies by spray forming. In such a case it is desirable to subsequently fill any residual porosity that results from a low spray deposition temperature.

There are a variety of approaches to this problem, but in one specific example a porous product was infiltrated at room temperature with a chemical ceramic sol. Such sols are well known in the ceramics industry. There are many ceramic sols available. In our case we used a very simple silica sol, and soaked the porous deposit in this. The product was then dried, and fired at a low temperature of 200° C. for two hours to produce silica ceramic within the surface porosity. The porosity was not completely filled at this stage, but repetition of the same process three more times, making four treatments in all, substantially filled the porosity in question.

The final product was therefore substantially fully dense at the surface, with significant penetration of full density below the surface. The silica produced inside the pores was also well bonded to the metal, with evidence of bonding to natural oxides that would have been present within the pore cavities.

EXAMPLE 10

In this example, the two arc spray guns were set up as described in Example 1. A sprayed deposit using conditions similar to those described in Example 1 was formed on the substrate to a thickness of approximately 6 mm. (The residual stress in the deposit was assumed to be compressive at this stage based on previous results and examples). The wires in Gun B (angled at 45 degrees to the substrate) were then changed from 0.8% carbon steel to aluminium. The spraying process was then continued using Gun B to spray deposit aluminum simultaneously with the Gun A spray depositing 0.8% carbon steel. Gun B was operated at 80 amps initially rising to 180 amps over a period of 60 seconds (i.e. the percentage of aluminum compared to 0.8% carbon steel in the deposit was gradually increased to produce a graded composition over this region). After 60 seconds of simultaneous spray deposition, the Gun A was switched off. Gun B continued to spray deposit aluminum at 180 amps for a further 6 minutes building up a thickness of approximately 8 mm of aluminum on top of the 0.8% carbon steel deposit.

The steady state temperature measured while the spray deposit of 0.8% carbon steel was being built up was 265° C. The steady state temperature measured while the aluminum was being deposited was measured as 183° C.

The deposit when removed from the substrate exhibited no change in shape. This result indicated that a neutral stress situation existed in the deposit prior to removal from the substrate. The spray deposited layer of 0.8% carbon steel alone (see Example 1) would have exhibited compressive stresses. The addition of a graded layer followed by an aluminum layer has had the effect of neutralising these compressive stresses i.e. the combination of compressive stresses generated when 0.8% carbon steel is spray deposited using conditions described in Example 1, were neutralised by the tensile stresses generated in the aluminum layer deposited on the 0.8% carbon steel.

EXAMPLE 11

In this case a single arc spray gun was positioned 220 mm from a rotating aluminum cylindrical mandrel (50.56 outside diameter×20 mm long). Commercial purity aluminum wire was sprayed onto the cylindrical mandrel using 200 amps current. Nitrogen was used as the atomizing gas, and metal was sprayed for 60 secs.

The sprayed deposit was removed from the mandrel by slitting to produce a split ring. The cut was along the axis of rotation of the mandrel and the change in dimension of the slit ring was recorded. The deposit opened up after slitting, to a maximum diameter of 51.24 mm. This result indicated that significant tensile stresses existed in the ring prior to cutting through the deposit. This was anticipated because there are no phase changes in pure aluminum, as it cools, to produce the volumetric increase required to compensate for the tensile stresses generated during spray deposition.

A second experiment was then carried out. In this experiment the spray conditions were identical to those described above, except that 10 micron particles of silicon carbide powder were injected into the spray plume of liquid aluminum droplets (near to the point of atomization). This procedure had the effect of introducing approximately 10% by volume of silicon carbide particles in the aluminum ring deposit. As before the ring was removed from the mandrel by slitting along its axis.

The diameter was observed to increase only slightly in this case, to 50.65 mm. The result shows that the introduction of silicon carbide particles has the effect of reducing the tensile stresses in arc sprayed aluminum deposits. There are two reasons for this, in combination.

Firstly, the injection of cold silicon carbide particles into the spray plume had the effect of lowering the average temperature of the spray. This then had the effect of reducing the overall thermal contraction taking place in the solid as previously described in connection with the behaviour of steels.

Secondly, it is well known that silicon carbide itself has a lower coefficient of thermal contraction than aluminum, and therefore the thermal contraction to be anticipated by the composite would be less anyway, so reducing the total thermal contraction stresses due to cooling.

Referring to FIGS. 3 to 5 and 3*a* to 5*a*, these illustrate in generalised schematic detail a deposition process using notionally sequentially deposited layers 1 to 6.

Figure 3:
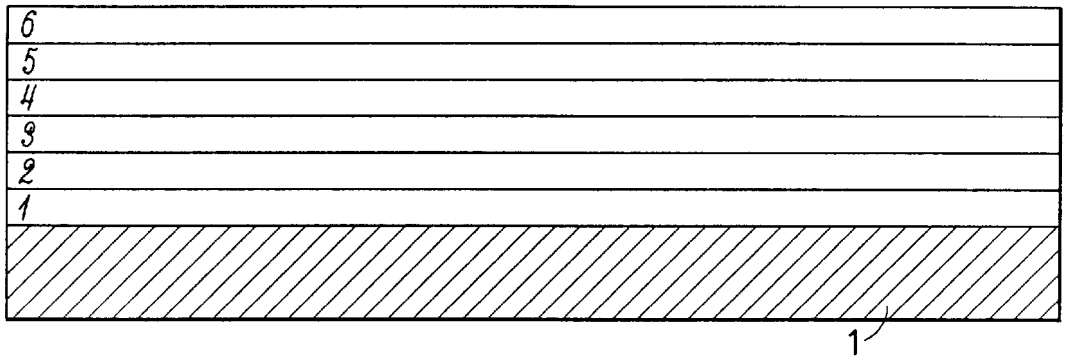
FIGS. 3 and 3*a* illustrate how this process would normally be expected to lead to the build up of tensile stresses due to the continuing arrival of relatively hotter droplets onto a relatively cooler deposit (the temperatures $T_s$ to $T_6$ in FIG. 3 correspond, for the purposes of illustrating the process, to those in FIG. 2).
Figure 3A:
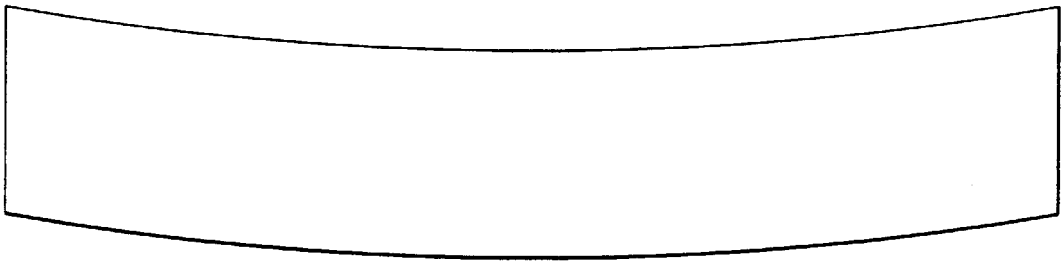

Referring initially to FIG. 3, layer 6 is the most recently deposited layer, which is semi-solid and at a droplet arrival temperature T6. Layer 5 is just solid (temperature T5) such that no stresses have yet developed. Layer 4 (temperature T4) is tensile with respect to layers 1,2 and 3 due to thermal contraction upon cooling between temperatures T5 and T4. Layer 3 is at a temperature T3 and is tensile with respect to layers 1 and 2 due to thermal contraction from T5 to T3. Layer 2 is at a steady state (equilibrium temperature Ts) and is tensile with respect to layer 1 due to thermal contraction from T5 to T2. Layer 1 is deposited on the substrate and is at steady state temperature Ts. It can be seen that in this example each solid layer is in tension with respect to the immediately underlying layer. There is no phase change in the solid state to compensate for thermal contraction stresses, and upon removal from the substrate deformation of the sprayed deposit occurs, to the form shown in FIG. 3*a*.

Figure 4:
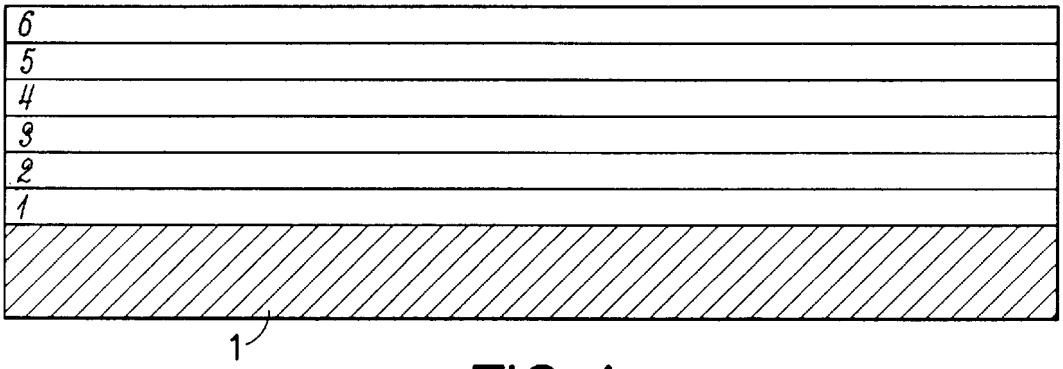
FIGS. 4 and 4*a* illustrate a similar effect, but this time the tensile stresses are compensated for, schematically, through a phase change, and a volume increase due to this phase change, occurring at temperature $T_3$, where the temperatures are also the same as those illustrated schematically in FIG. 2.
Figure 4A:
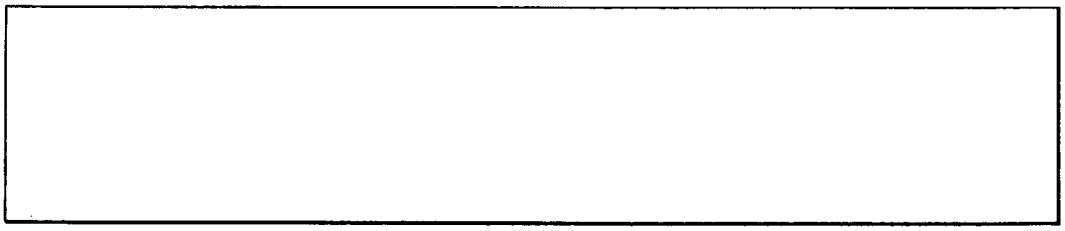

Referring to FIG. 4, layers 6 and 5 are in similar conditions to those described for FIG. 3 (no stress developed). Cooling of the deposit (or controlling of steady state temperature) and/or metal composition or atomizing gas are tailored such that layer 4 (at temperature T4) is tensile with respect to layers 1 and 2 due to contraction from T5 to T4, but layer 3 (temperature T3) undergoes a compensating phase change with increase in volume to be neutral with respect to layers 1 and 2. This phase change compensates for thermal contraction stresses resulting in the deposit retaining its dimensional accuracy when removed from the substrate and cooled to ambient temperature, as shown in FIG. 4*a*.

Figure 5:
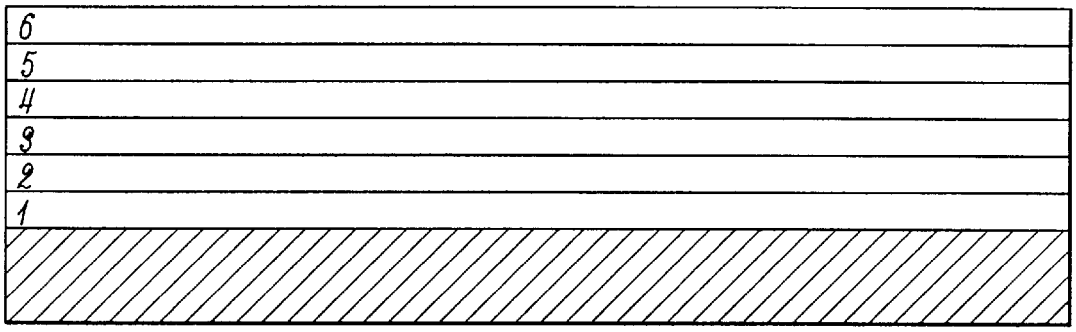
FIGS. 5 and 5*a* illustrate a process similar to that of FIGS. 4 and 4*a* and FIG. 3 and 3*a*, but where a phase/volume change over compensates for thermal contraction stresses such that, on release from the substrate, deformation occurs due to compressive stresses.
Figure 5A:
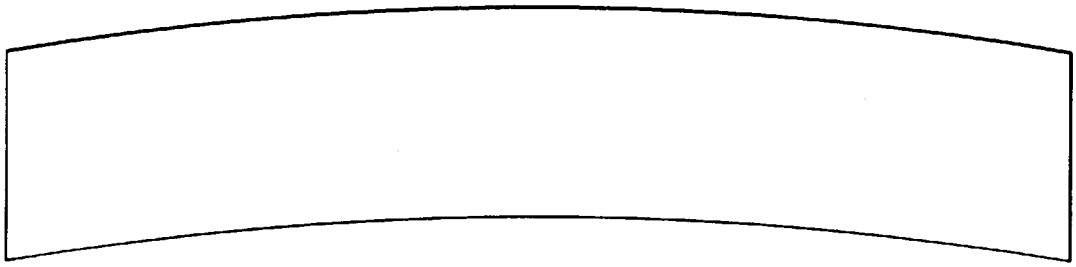

FIG. 5 shows the situation when the phase change in the solid state overcompensates for thermal contraction stresses to the extent that there is compressive deformation of the deposit upon removal from the substrate, as shown in FIG. 5*a*.

Figure 6:
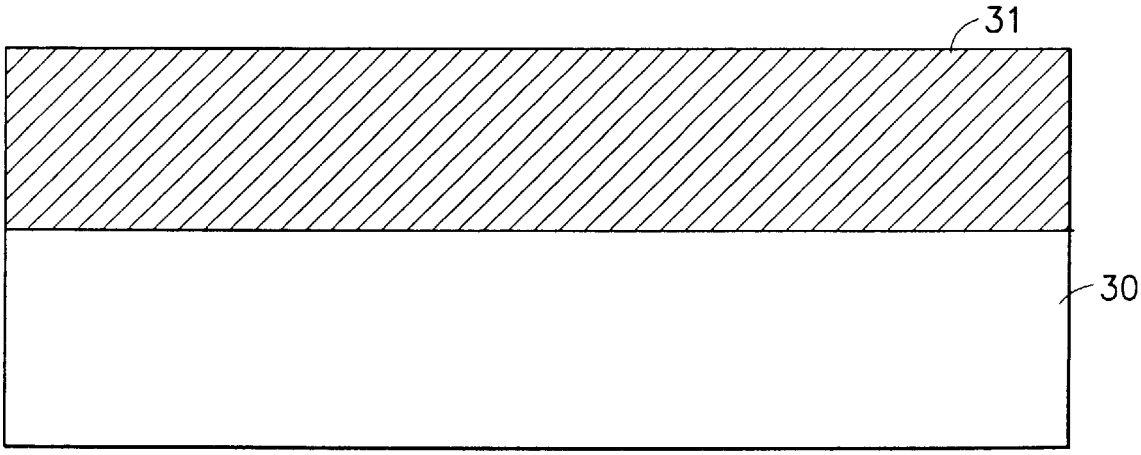
FIG. 6 illustrates a further deposition process resulting in compensated stresses.
Figure 7:
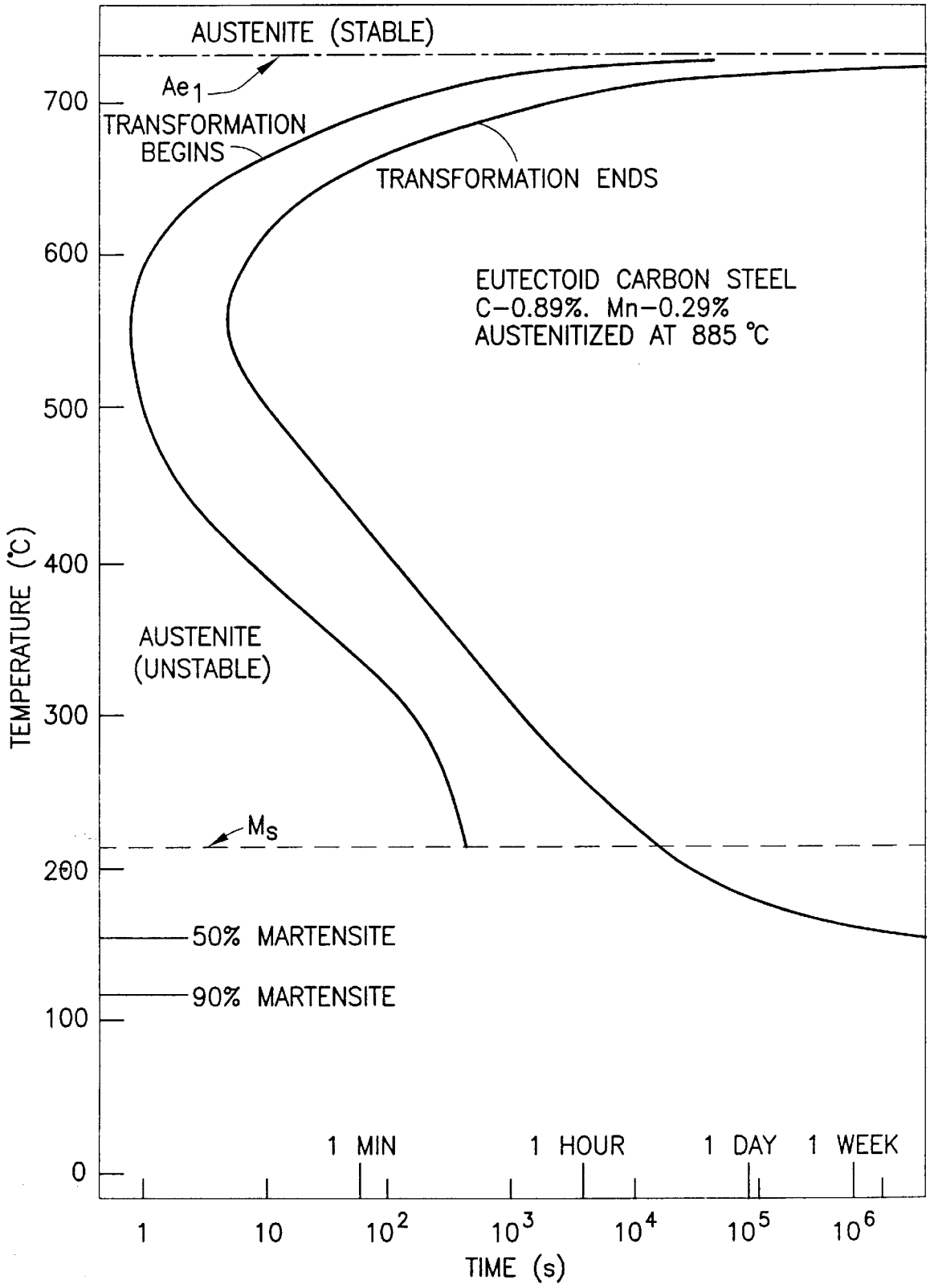
FIGS. 7 and 8 are respectively, a temperature—time transformation diagrams, and a phase diagram for steel materials suitable for use in the process according to the invention.
Figure 8:
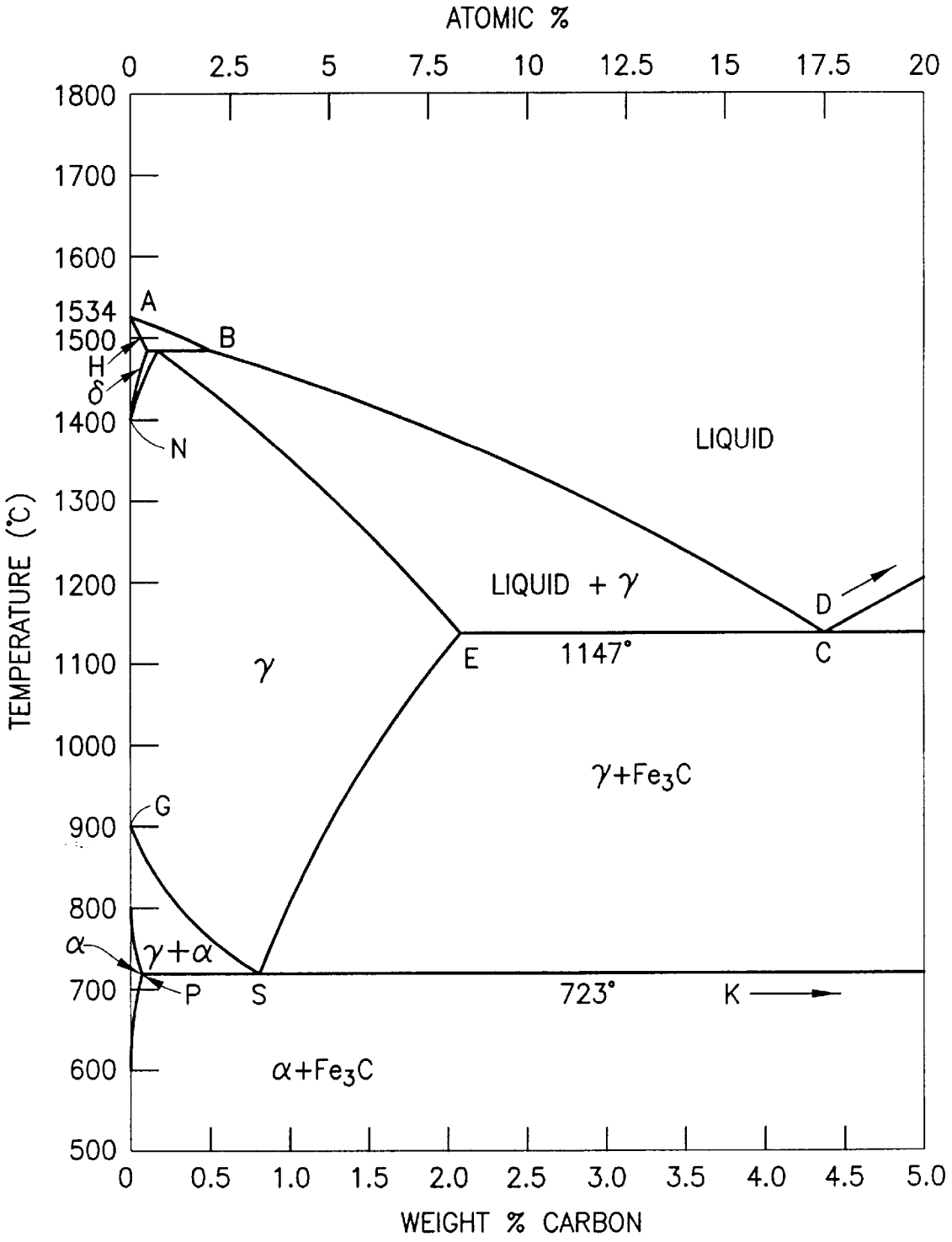

FIG. 6 shows a situation in which deposition is tailored such that a steel layer 30 is deposited in compression, with an aluminum layer 31 subsequently being deposited in tension such that the overall "stress system" of the product is neutral (i.e. there is no deflection/deformation).

What is claimed is:

1. A method for manufacturing a metallic article, comprising:

a) forming said metallic article on a substrate by, i) first depositing atomized metal so as to cause at least partial solidification of the deposited metal, ii) depositing further atomized metal onto said at least partially solidified first deposited metal iii) allowing the first and further deposited metal to fully solidify, wherein during the forming process A) the cooling of the atomized first and further deposited metal, and B) the composition of the first and further deposited metal and/or of a gas used in the atomization of the first and further deposited metal, are coordinated as parameters such that thermal volumetric contraction on solidification and cooling of said first deposited metal is compensated for, when said first and further deposited metal has been cooled to ambient temperature, by volumetric expansion in a reaction or phase change in said further atomized and deposited metal; and b) removing said metallic article from said substrate, wherein the compensation is such that after said metallic article is removed from said substrate said metallic article is substantially free from stress-induced dimensional distortion.

2. A method according to claim 1, wherein:

said phase change in said further deposited metal comprises a solid state phase change.

3. A method according to claim 2, wherein:

said volumetric expansion in said further deposited metal results from a martensitic phase change.

4. A method according to claim 3, wherein:

said atomized metal of said first deposited metal comprises at least one stream of atomized steel directed towards the substrate to form sequentially deposited layers of steel, and wherein the cooling of the stream of atomized steel and/or the deposited steel is coordinated to cause a martensitic phase transformation to take place in the further deposited steel which compensates for said volumetric contraction.

5. A method according to claim 4, wherein:

said at least one stream of atomized steel is produced using atomizing gas containing no more than 20% by weight of oxygen, the balance predominantly comprising a non-reducing, non-oxidizing gas.

6. A method according to claim 4, wherein:

the steel is deposited under conditions such that the equilibrium temperature of the deposit during the deposition process is above the temperature of martensitic transformation.

7. A method according to claim 1, wherein:

said reaction comprises reaction of the first and further deposited atomized metal with atomizing gas, resulting in formation of reaction products.

8. A method according to claim 7, wherein:

said reaction is oxidization.

9. A method according to claim 1, wherein:

said phase change comprises adding a further material phase during deposition.

10. A method according to claim 9, wherein:

said further material phase has a coefficient of thermal expansion substantially less than that of the first and further deposited metal.

11. A method according to claim 9, wherein:

said further material phase is added to form a matrix with said further deposited metal during deposition.

12. A method according to claim 9, wherein:

said further material phase is added as a separate layer in alternation with a layer of said further deposited metal.

13. A method according to claim 1, wherein:

one of reinforcement fibers, whiskers, and particles are embedded in the further deposited metal.

14. A method according to claim 1, wherein:

the substrate is at least one of translated, reciprocated, and rotated in an atomized spray of metal comprising the first and further deposited metals.

15. A method according to claim 1, further comprising:

c) spray peening at least part of said metallic article.

16. A method according to claim 1, wherein:

said atomized metal of said first and further deposited metals comprises a plurality of atomized metal sprays of differing composition to produce a layer structure, and/or at least one graded layer of graded composition in which the relative proportions of the differing compositions vary through the depth of the or each graded layer.

17. A method according to claim 1, wherein:

said atomized metal of said first and further deposited metals comprise at least two streams of atomized metal which are deposited onto said substrate, either together to form an intimate mixture of the metals, or sequentially to form a layered structure, wherein at least one of said streams of atomized metals is deposited by said first depositing atomized metal onto a substrate so as to cause at least partial solidification of the deposited metal, said depositing further atomized metal onto said at least partially solidified first deposited metal on said substrate, and said allowing the first and further metal to fully solidify on said substrate.

18. A method according to claim 17, wherein:

an alloying occurs between the plurality of metals.

19. A method according to claim 1, wherein:

said atomized metal of said first and further deposited metals comprise a plurality of metals atomized together using a spray source, and deposited onto the same substrate to form an intimate mixture of said metals, at least one of said metals being deposited by said first depositing atomized metal onto a substrate so as to cause partial solidification of the deposited metal, said depositing further atomized metal onto said at least partially solidified first deposited metal on said substrate, and said allowing the first and further deposited metal to fully solidify on said substrate.

20. A method according to claim 1, further comprising:

c) treating said metallic article to reduce a porosity of said metallic article.

21. A method according to claim 20, wherein:

said treating includes impregnating said metallic article with a ceramic sol.

* * * * *